US007334406B2

(12) United States Patent
Licari et al.

(10) Patent No.: US 7,334,406 B2
(45) Date of Patent: Feb. 26, 2008

(54) HYBRID GEOTHERMAL AND FUEL-CELL SYSTEM

(75) Inventors: James P. Licari, Rochester, MN (US); Hal H. Ottesen, Mazeppa, MN (US); Jim Walters, Rochester, MN (US)

(73) Assignee: Regents of the University of Minnesota, St. Paul, MN (US)

( * ) Notice: Subject to any disclaimer, the term of this patent is extended or adjusted under 35 U.S.C. 154(b) by 195 days.

(21) Appl. No.: 11/047,415

(22) Filed: Jan. 31, 2005

(65) Prior Publication Data

US 2006/0053794 A1 Mar. 16, 2006

(51) Int. Cl.
*F03G 7/00* (2006.01)

(52) U.S. Cl. ..... 60/641.2; 60/641.8

(58) Field of Classification Search ..... 60/641.2, 60/641.3, 641.8; 429/24, 26
See application file for complete search history.

(56) References Cited

U.S. PATENT DOCUMENTS

| | | | | |
|---|---|---|---|---|
| 6,688,129 | B2 * | 2/2004 | Ace | 62/260 |
| 7,056,611 | B2 * | 6/2006 | Fabis et al. | 429/24 |
| 2002/0037447 | A1 * | 3/2002 | Imaseki et al. | 429/26 |
| 2004/0224193 | A1 * | 11/2004 | Mitlitsky et al. | 429/13 |

OTHER PUBLICATIONS

Bony, P., "Fuel Cells: An Emerging Market Opportunity", *RSES Journal*, (Dec. 2002), 3 pgs.

* cited by examiner

*Primary Examiner*—Hoang Nguyen
(74) *Attorney, Agent, or Firm*—Schwegman, Lundberg & Woessner, P.A.

(57) ABSTRACT

A hybrid energy system heats or cools a plant with a geothermal unit powered at least partly by a fuel cell, which may also power other devices. The thermal fluid for the geothermal unit also cools the fuel cell via a heat exchanger. A digital controller bypasses a variable portion of the thermal fluid around the heat exchanger to regulate the fuel-cell temperature.

22 Claims, 4 Drawing Sheets

HYBRID GEOTHERMAL AND FUEL-CELL SYSTEM

TECHNICAL FIELD

The present invention relates to geothermal heating/cooling, and to electricity generation by fuel cells.

BACKGROUND

Geothermal heating and cooling systems have become more popular for residences, new local residential community developments, industrial buildings, and other facilities in many geographic areas. They are capable of both heating and cooling, and even relatively small locations contains sufficiently large reservoirs of thermal energy. A typical suburban home may occupy a lot containing ten times the thermal energy required for an entire heating season. The energy is transferred to the facility via a heat-exchange system in a geothermal field with long sections of underground or underwater pipe containing a thermal fluid to transfer latent heat to the building during cold weather, and to transfer heat from the building to the field in hot weather. Most geothermal installations circulate a fluid such as glycol and water in a closed loop, but some may circulate locally available water in an open loop.

Fuel cells are gaining prominence as a source of electrical energy. A fuel cell is an electrochemical cell capable of converting chemical energy from a fuel and an oxidant to electricity with essentially invariant electrodes and electrolytes A number of cell types exist, and many different fuels are suitable for either direct use, or for indirect use after reforming. Although current fuel cells find applications in smaller capacities, their size, capability, and efficiency grow constantly.

Geothermal units commonly require electricity to drive the compressor, the fan, and the pump(s) that circulate their thermal fluids. Fuel cells commonly generate significant quantities of heat that is carried off by fluid-based (usually air or water) cooling systems and vented to maintain safe and efficient operating temperatures within the cells. That is, the heat generated by fuel cells is usually considered waste heat, and is disposed of without recovery. Several advantages would accrue to a composite system having coupled geothermal and fuel-cell components, if a way could be found to coordinate the stable temperature requirements of the fuel cell with the usually highly changeable and sometimes conflicting heat-transfer requirements of the geothermal system. Particular advantages may accrue to isolated buildings or other facilities, where outside electrical power may be difficult to obtain, or to facilities where returning co-generated power to a grid may be a viable option.

SUMMARY

Embodiments of the present hybrid energy system couple a geothermal unit to a fuel cell so that the fuel cell provides at least some of the power for operating the geothermal unit, and the thermal fluid of the geothermal unit cools the fuel cell. A digital control unit senses fuel-cell temperature and bypasses a variable amount of the thermal fluid around the fuel cell to regulate its temperature.

Such embodiments find utility in many different kinds of buildings or other structures and environments. Some of them may be especially convenient in isolated locations where outside electrical power may be difficult to supply.

DRAWING

DESCRIPTION

Figure 1:
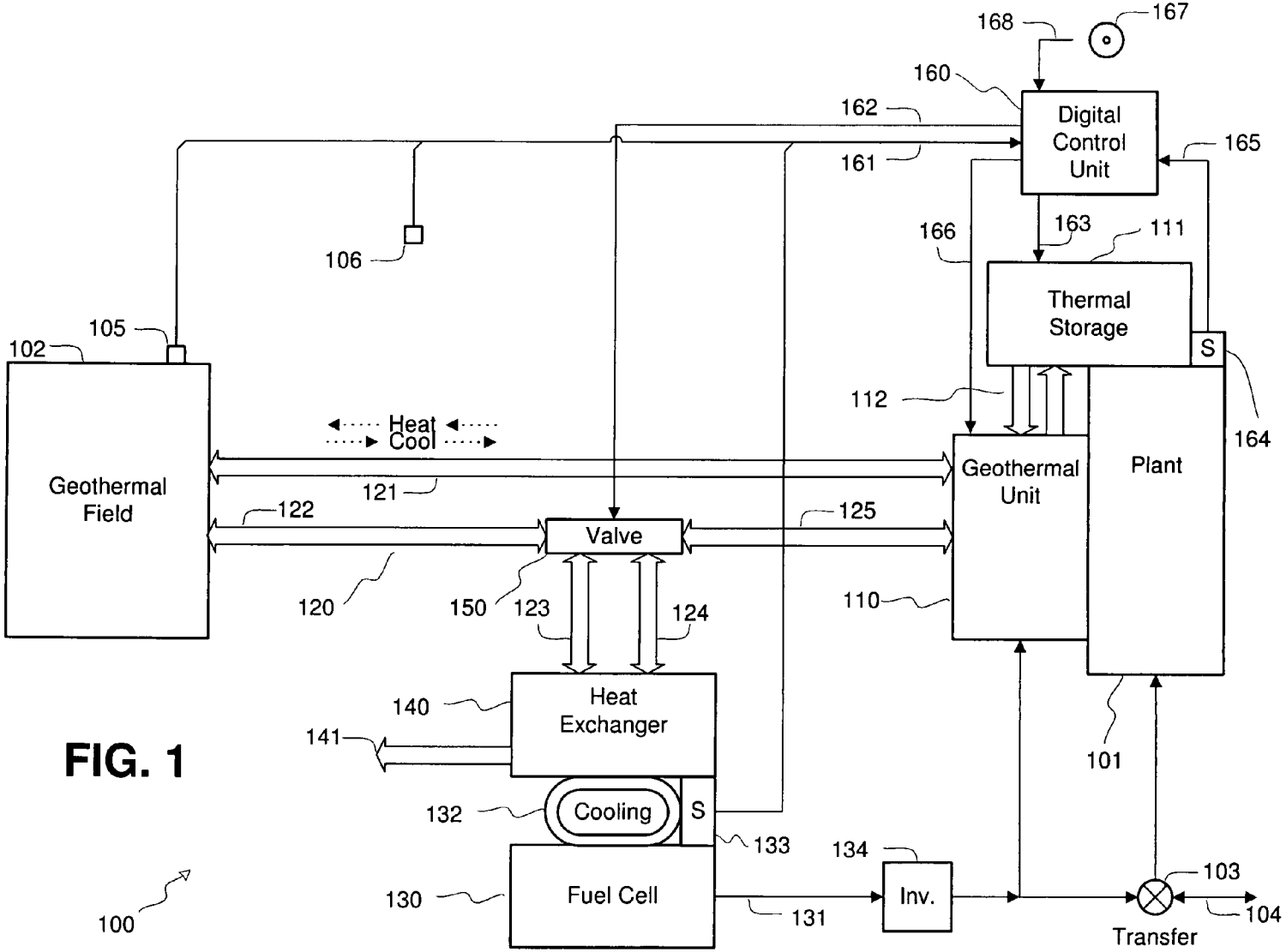
FIG. 1 is a block diagram of an example hybrid system.

FIG. 1 shows a representative hybrid system 100. A plant 101, such as a dwelling, industrial building, or other structure, is to be heated and/or cooled. A geothermal heating/cooling unit 110 includes pumps, fans, and other components for heating and/or cooling plant 101 in any conventional manner; this unit is sometimes called a geothermal heat pump. Loop 120 circulates a thermal fluid, such as water or glycol, between unit 110 and a geothermal field 102, which may be closed-loop or open-loop. Thermal storage 111, such as tanks, water heaters, heated floors, community swimming pools, and/or other facilities, may be coupled to unit 110 via pipes 112 to store excess heat from unit 111. Thermal storage may be located inside or outside plant 101, and may be also recharged from another energy source as well, such as gas, wind power, or off-peak electricity.

Fuel cell 130 converts hydrogen and oxygen (or other fuels) to electricity for transmission via electrical power output 131. Because fuel cells generate heat, they include cooling apparatus 132 for dissipating excess heat. Further, many present fuel-cell systems waste the heat generated by the fuel cell. Heat exchanger 140 couples to cooling apparatus 132 to remove excess heat therefrom. Cooling apparatus 133 may include a separate loop of coolant flowing between cell 130 and heat exchanger 140, or it may be integrated into exchanger 140 if desired. Sensor 133 detects a temperature of the fuel cell, and may be positioned at any convenient location in cell 120, cooling apparatus 132, or heat exchanger 140.

Loop 120 comprises pipe 121 between geothermal unit 110 and field 102, which may be open-loop or closed-loop. Pipes 122 and 123 connect field 102 to heat exchanger 140 via an adjustable valve 150. Pipes 124 and 125 couple the heat exchanger to geothermal unit 110. When system 100 heats plant 101, the thermal fluid flows counterclockwise in pipes 121-125 of loop 120. In this way, heat exchanger 140 also supplies heat to plant 101 and/or to thermal storage 111, thereby decreasing the amount of work required from geothermal unit 110. When the system is called upon to cool the plant, the fluid flows clockwise through the loop. In this configuration, heat from fuel cell 130 may be shunted to the air or other medium to avoid heating geothermal field 102. if desired. This heat may be drawn of by vent 141 or other suitable means from any convenient point, such as cooling apparatus 132 or heat exchanger 140.

Fuel-cell output 131 may supply electricity to the relevant components of system 100, including geothermal unit 110 and control unit 160. Output 131 may also provide electrical power to some or all of the electrical equipment of plant 101. If desired, a manual or automatic transfer switch 103 may selectively supply power to plant 101 from the fuel-cell output or from external mains 104. In some cases, output 131 may provide supply surplus electrical power to mains 104 as a co-generation facility. Inverter 134 may convert the fuel cell's DC output to AC for some or all of the loads connected to output 131.

A valve 150 is adjustable to bypass variable amounts of the thermal fluid around heat exchanger 140. Valve 150 may comprise one or multiple valves, and may be inserted at any convenient point in loop 120, so as to restrict the amount of fluid flowing through heat exchanger 140.

Digital control unit 160 controls the amount of fluid that bypasses exchanger 140 through valve 150. Input 161 receives the fuel-cell temperature from sensor 133, and produces an output 162 to adjust valve 150 so as to allow sufficient fluid into exchanger 140 for maintaining cell within a safe and efficient internal temperature range of the fuel cell 130. Unit 160 may also control heat flow between unit 110 and thermal storage 111, as indicated by line 163. One or more sensors and/or switches 164 may report temperatures and/or other conditions in plant 101 on line 165, and may permit operator control of certain functions, such as switching between heating and cooling modes. Control output 166 causes unit 110 to carry out such functions. Some embodiments may employ additional sensors, such as shown at 105 and 106, to detect geothermal-field temperature and ambient outside air temperature. Control unit 160 may employ digital logic hardware and/or a stored program for a digital processor to maintain proper temperatures within fuel cell 130. One or more stored programs may reside on a storage or transmission medium, such as disc 167 or a network connection 168. Unit 160 may also bypass all thermal fluid around heat exchanger 140 during the cooling season, if desired to avoid heating field 102.

Figure 2:
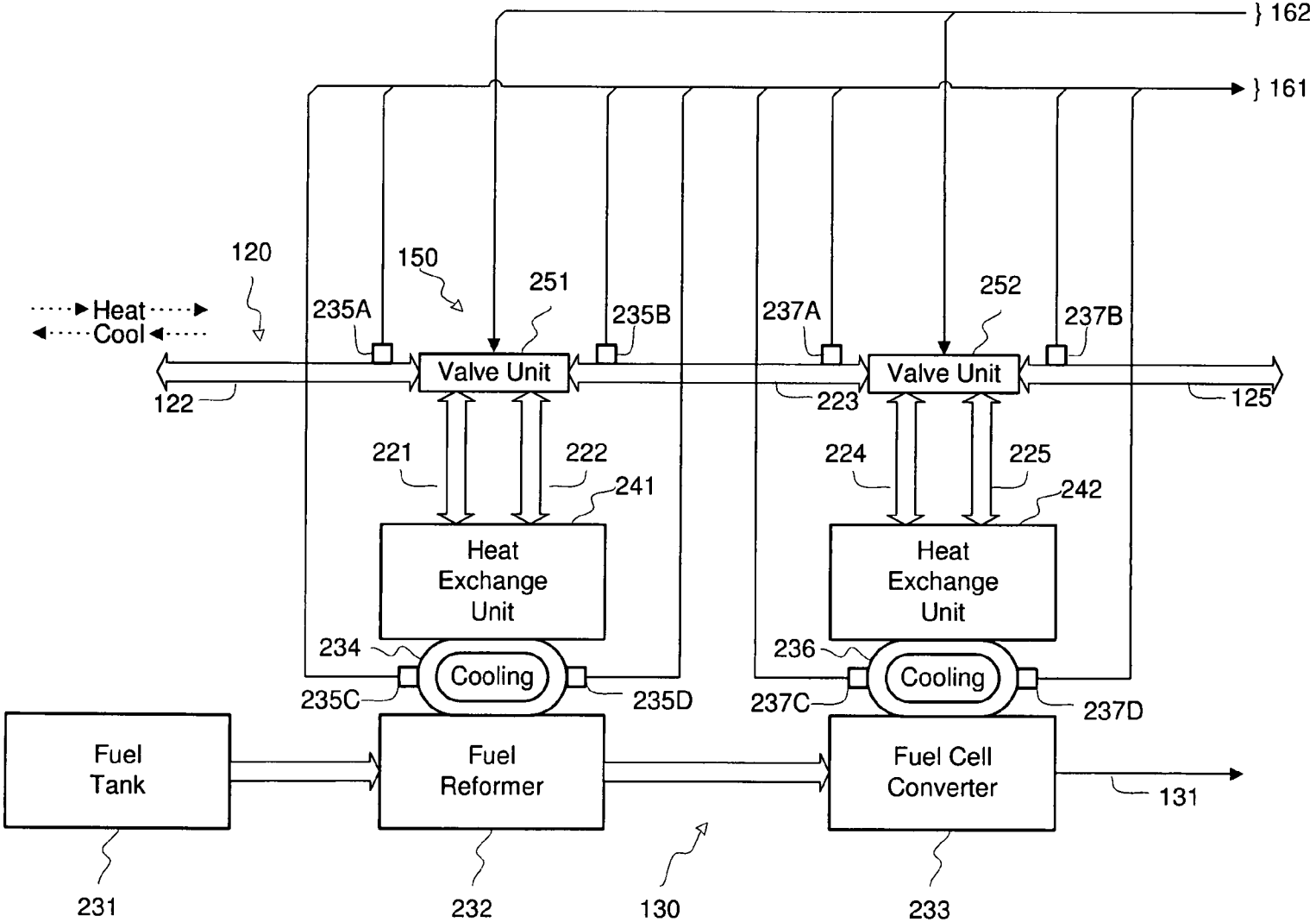
FIG. 2 is a more detailed block diagram of a portion of a hybrid system.

FIG. 2 shows fuel-cell, heat-exchanger, and valve components for a representative system. Fuel tank 231 holds methane or another suitable indirect fuel for fuel cell 130. A reformer 232 converts this fuel to hydrogen for direct use in fuel-cell converter 233. Alternatively, a storage facility 231 could store hydrogen in a convenient form for direct use by converter 233.

Both reformer 232 and converter 233 produce heat that must be dissipated for safety and for efficient operation.

Cooling apparatus 234 removes heat from the reformer and passes it to heat exchange unit 241. Apparatus 234 may have its own coolant loop, or it may be integrated with another loop in system 100. Sensor units 235A-235D report temperatures related to reformer 232, apparatus 234, and/or unit 241 to control unit 160 by a line 161. Heat exchange unit 241 couples to thermal-fluid loop 120 via pipes 125 and 221 for removing heat from reformer 232 via apparatus 234. Bypass valve unit 251 selectively bypasses a variable amount of thermal fluid in loop 120 around exchange unit 241, and passes the rest through the exchange unit. A control-unit line 162 determines how much fluid is bypassed.

Cooling apparatus 236 removes heat from converter 242 to heat exchange unit 242. Again, apparatus 234 may have its own loop, or may be integrated with another loop. Sensor units 237A-237D report one or more temperatures related to the converter, apparatus 234, and/or unit 241 to control unit 160 by a line 161. Heat exchange unit 242 couples to thermal-fluid loop 120 via pipes 221 and 125 for removing heat from converter 233 via apparatus 236. Bypass valve unit 252 selectively bypasses a variable amount of thermal fluid in loop 120 around exchange unit 242, and passes the rest through it. Another control-unit line 162 determines how much fluid is bypassed. Valve units 251 and 252 may be placed at other locations relative to each other, and at other locations in loop 120. The system shown in FIG. 2 allows independent control of the temperatures in reformer 232 and converter 233, so that each of these units may operate within its own individual safety and efficiency envelopes.

Digital control unit 160 senses and regulates a number of temperatures within system 100, FIG. 1. Unit 160 responds to temperature settings and actual temperatures in plant 101 to cause geothermal unit 110 to adjust the direction and rate of flow of thermal fluid in loop 120. Unit 160 may also respond to settings and actual temperatures in thermal storage 111 (or in plant 101) to control fluid flow in pipes 112 and/or to couple storage 111 to loop 120.

Independently of the above functions, digital control unit 160 also controls one or more temperatures within fuel cell 130. Using the more detailed components of FIG. 2 as an example, assume that the thermal fluid in loop 120 flows counterclockwise (i.e., to heat the plant) at a flow rate Q. Represent the inlet and outlet temperatures of loop 120 to exchange unit 242 at sensors 237A and 237B as TA and TB. Arbitrarily assume a clockwise coolant flow between fuel cell converter 233 and heat exchange unit 242 in cooling apparatus 236. (The flow rate within apparatus 242 may be constant, or may be variable in response to a separate control, not shown, for maintaining an acceptable temperature T0 within fuel cell converter 233. Represent the inlet and outlet temperatures of exchange unit 242 from cooling unit 236, at sensors 237C and 237D, as TC and TD. These sensors and their locations are employed herein to explain the operation of the system. They may be located at various physical points, and some of them may be omitted (e.g., if TA in sensor 237A substantially equals TB in sensor 235). Because TB>TA, heat from converter 233 of fuel cell 130, that would otherwise be wasted, flows into loop 120 and thereby decreases the geothermal energy required by geothermal unit 110, FIG. 1. Return flow to geothermal field 102 in pipe 121 has a temperature TE, where TE<TA and TE<TB, decreasing overall energy usage in system 100.

Switching system 100 to a mode for cooling plant 101 reverses the flow of thermal fluid in loop 120. In this situation, the fluid flows clockwise, that is, from right to left in FIG. 2, and TA>TB. Pipes 224, 223, and 122 thus carry the heat from fuel cell converter 233 to geothermal field 102 for dissipation. Dumping fuel-cell heat in the field may in some cases be unobjectionable during cooling mode, or even desirable. For example, the field may be retained sufficiently long to aid in a later heating mode. In other cases where field heating is not desired, geothermal unit 110 may couple, say, a vent or pipe 141 to pipes 112 so as to employ the fuel-cell heat to heat a water heater, swimming pool, or other thermal storage 111. Some or all of the fuel-cell heat may be dumped to ambient air from vent 141 as well. In some cases, control unit 160 may determine the disposition of fuel-cell heat during cooling mode among one or more of the above or other sinks in response to a temperature of the thermal fluid in loop 120, a geothermal field temperature at sensor 105, and/or an ambient outside air temperature at 106.

Again using fuel cell converter 233 as an example, sensor 237C may detect that a temperature inside converter 233 is approaching an upper limit of the range for safe and efficient operation. At that point, controller 160 actuates valve unit 252 to increase the flow rate of thermal fluid from pipes 223 and 125 of loop 120 into heat exchange unit 242, via pipes 224 and 225. On the other hand, when the temperature is decreasing below the upper limit, controller 170 actuates valve unit 252 to bypass less of the thermal fluid to exchange unit 242, and to bypass more of the fluid directly between pipes 223 and 125. A fuzzy-logic approach may be employed to set the bypass fraction kQ of the total thermal-fluid flow Q.

Figure 3:
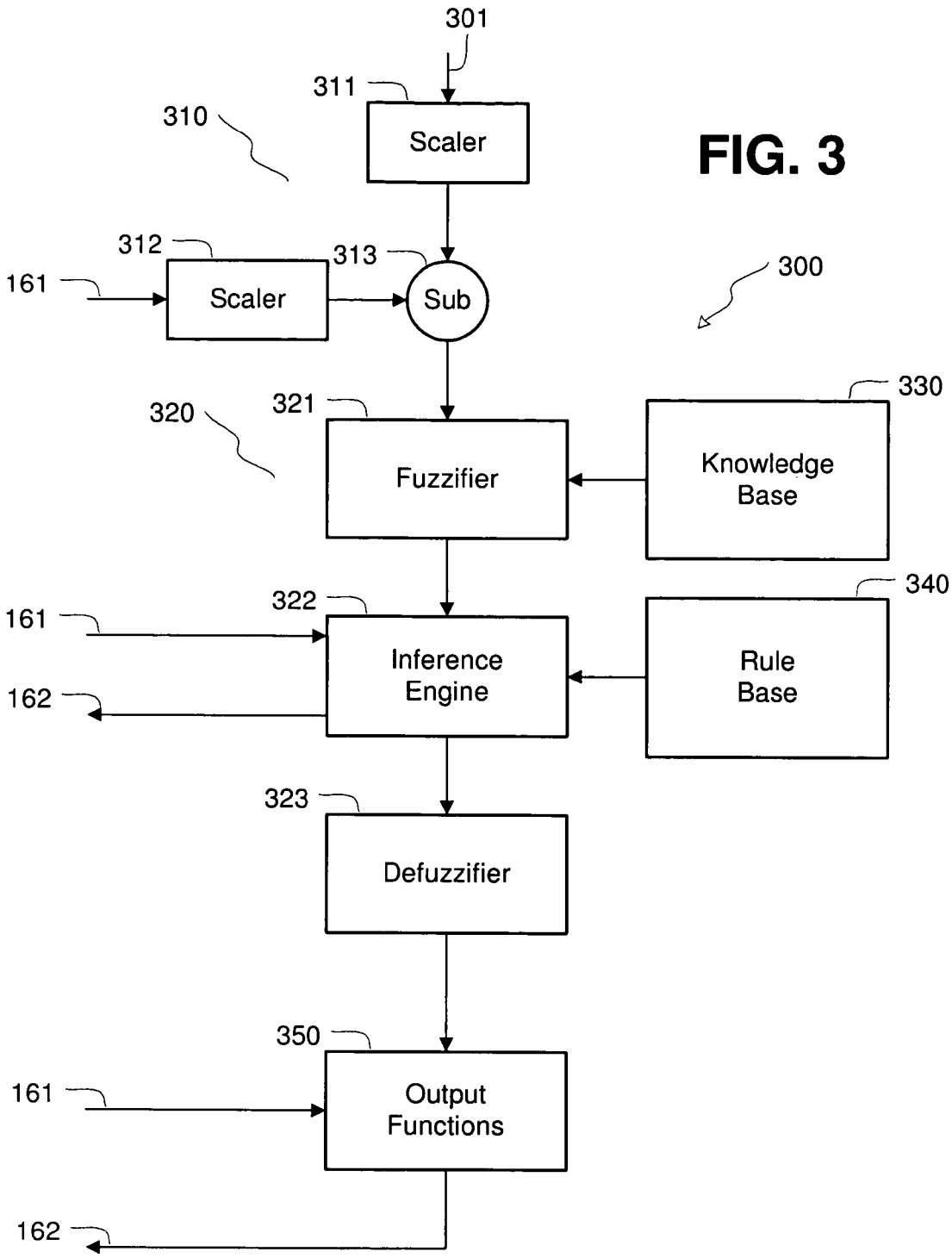
FIG. 3 is a partial block diagram of a control unit useful in FIG. 1.
Figure 4:
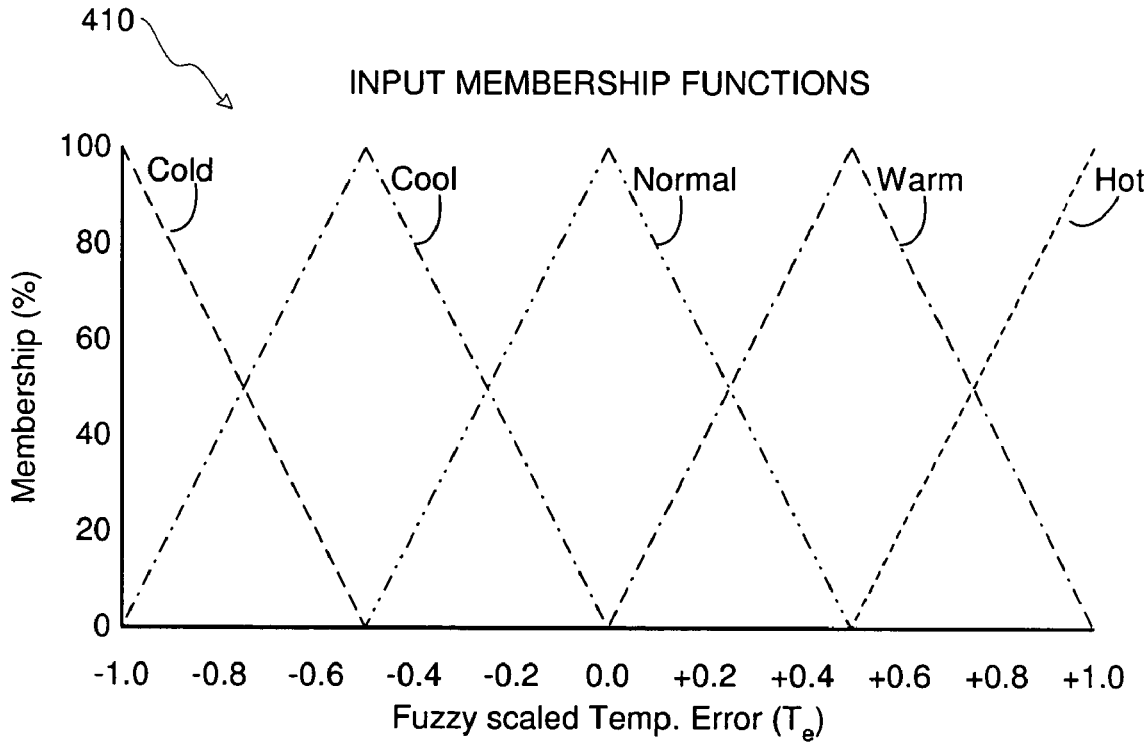
FIG. 4 shows functions useful in the control unit of FIG. 3.
Figure 4:
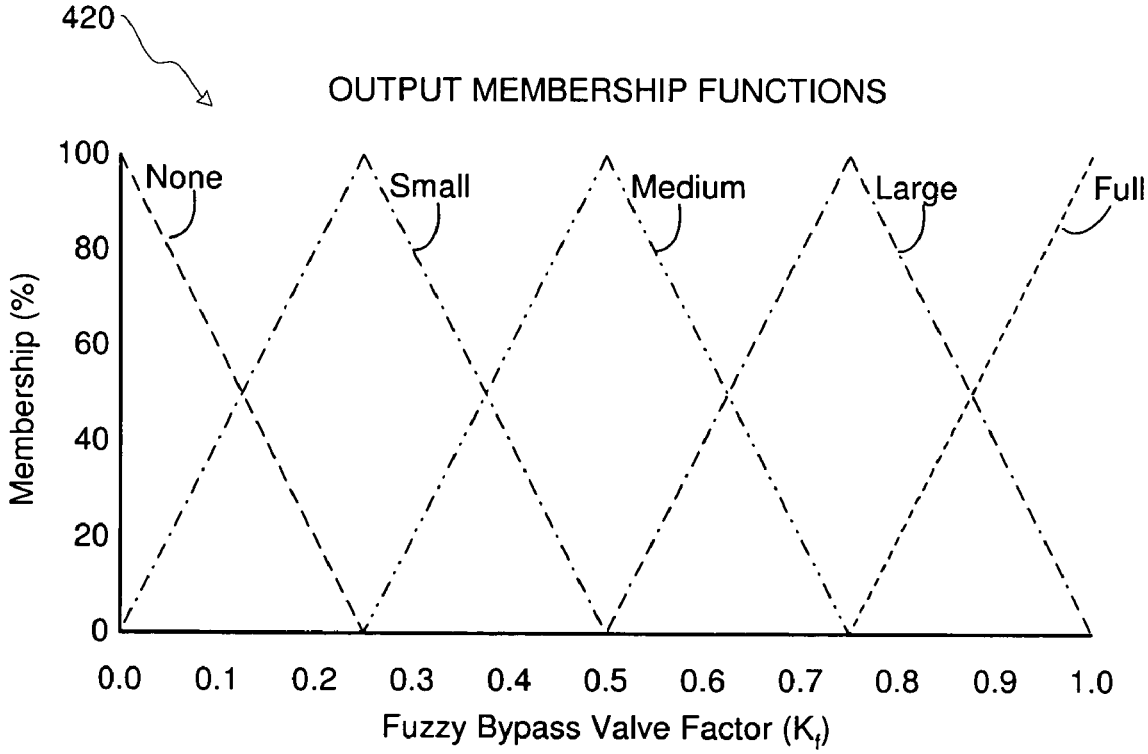

FIG. 3 is a block diagram of an example fuzzy-logic unit 300 useful in digital control 160, FIG. 1, for controlling temperature within fuel cell 130, FIG. 1. Unit 300 may also be employed separately for converter 232 and reformer 233 of FIG. 2. It is important to maintain fuel cell 130 near a constant operating temperature T0. Most fuel cells include their own internal temperature-control systems using either air or liquid cooling. Error module 310 inputs a stored or calculated set point or desired operating temperature T0 on line 301 (e.g., for reformer 232 or for converter 233) into scaler 311. An actual or stack temperature Tx (e.g., TC from sensors 235C or 237C) enters from line 161 and is scaled at 312. Subtractor 313 calculates the error Te=T0−Tx between desired and actual temperatures. For simplicity, assume the inputs are scaled so that Te lies in the interval [−1, +1]. In calculation unit 320, block 321 fuzzifies the error according to a number of predefined stored membership functions from knowledge base 330. Knowledge base 330 contains information concerning the various system units and variables, such as reformer 232, converter 233, ambient air temperature, thermal-fluid temperature, temperature of storage 111 and plant 101, and heating/cooling mode settings from controls 164. All of these and more may be taken into account in determining which proportions of which classes or term sets to assign to an error Te for any of the controlled devices. For example, if Te=−0.2, its fuzzy value may have a 40% membership in a {cool} function—sometimes called a range or a class—and a 60% membership in a {normal} function, with 0% membership in other functions. FIG. 4 includes a graph 410 showing an example regime of percentage membership in five classes ({cold}, {cool}, {normal}, {warm}, and {hot}) plotted against scaled values of the error Te. More precise units 310 may derive and use error gradients dTe/dt as well, in partitioning error membership among multiple classes; for example, a high negative gradient could skew membership from {normal} toward the {cool} function. Inference block 322 infers a fuzzy output control variable Kf by approximate reasoning from a set of predefined rules in rule base 340. Usually, the rules are in "if . . . then . . . " form, and multiple rules will each contribute some amount to the values of Kf. As an example, a simple rule base 340 may contain five rules:

(1) IF Te is {cold}, THEN Kf is {none}
(2) IF Te is {cool}, THEN Kf is {small}
(3) IF Te is {normal}, THEN Kf is {medium}
(4) IF Te is {warm}, THEN Kf is {large}
(5) IF Te is {hot}, THEN Kf is {full}.

In the above example where Te=−0.2, rules (2) and (3) would contribute to Kf, but the other rules would not be activated. The names of the output membership functions (or ranges or classes), {none} through {full}, refer to bypass amounts in valve(s) 150. In the example, Kf might have a 60% membership in output class "medium" and a 40% membership in "small." FIG. 4 includes a graph 420 showing values of Kf for various percentage membership values in each of the five output classes or functions.

Block 322 may also accept other inputs 161, and rule base 340 may include these other inputs in various ones of the rules. For example, if unit 300 is currently determining an output for fuel-cell converter 233, block 322 may also accept an error for reformer 232, an ambient air temperature from sensor 105, a heating/cooling mode setting from controls 164, and a number of other environmental quantities as well. Existing or additional rules in rule base 340 may then incorporate these quantities (either precise values or fuzzified) to infer output Kf, and to infer additional output signals on line 162. For example, a rule might specify that IF (system in cooling mode) AND (Te is {hot}) AND (ambient-air is {warm} OR {hot}), THEN (Kf is {full}) AND (pipe 141 is to be coupled to inlet pipe 112 of thermal storage 111).

Some outputs, such as a signal to couple vent 141 to pipes 112, may proceed directly or indirectly to individual control lines 162.

Block 323 defuzzifies the output control quantity Kf by disjoining the membership contributions of each rule to provide a control signal K. Signal K may be calculated in a number of different ways. One example method is to form it as the centroid of the calculated Kf contributions from the various output functions. Chapter 13 of Timothy J. Ross, Fuzzy Logic with Engineering Applications, 2d Ed. (2004), John Wiley & Sons, ISBN 0-470-86074-8, describes aspect of fuzzy-logic systems relevant to this description, ands is hereby incorporated by reference. K, in the range [0,1], signifies a mixing constant for the particular valve that it controls. If the total flow in loop 120 is Q, a bypass valve 150 splits it into component Q1=(1−K)Q that bypasses its associated heat exchanger, and a flow Q2=KQ that flows through the heat exchanger.

Output K may be employed as calculated, or may be father modified in output block 350 before being output on line 162 to actuators for valve(s) 150. For example, an integrator or low-pass filter may improve performance in some situations. An input 161 from controls 164, FIG. 1, may reroute or otherwise modify which particular valves are actuated, as described hereinabove for heating/cooling mode or for other purposes.

Unit 300 operates similarly for reformer 232, employing temperatures TA, TB, TC, and TD at sensors 335A-235D, respectively, and controlling bypass valve unit 251. The autonomous controls for maintaining proper temperatures in the components 232 and 233 of fuel cell 130 do not interfere with any controls for maintaining plant 101 at a proper temperature, and in fact may be made entirely independent of them in controller 160 or even in a separate controller, not shown.

The foregoing description and the drawing illustrate specific aspects and embodiments of the invention sufficiently to enable those skilled in the art to practice it. Alternative embodiments may incorporate structural, logical, electrical, process, and other changes. Examples merely typify possible variations, and are not limiting unless explicitly so stated. Individual components and functions are optional unless explicitly required, and the sequence of operations may vary. Portions and features of some embodiments may be included in or substituted for those of others, in any combination. The Abstract fulfills a legal requirement to provide a search tool, and is not to be used for interpreting the claims.

We claim:

1. A hybrid energy system comprising:

a geothermal unit for heating and/or cooling a plant;

a fuel cell having an output for supplying electrical power to the geothermal unit;

a heat exchanger coupled to the fuel cell;

a loop for circulating a thermal fluid among the heat exchanger, the geothermal unit, and a geothermal field;

a valve for bypassing a variable portion of the thermal fluid around the heat exchanger;

a sensor for sensing a temperature of the fuel cell; and a digital control unit coupled to the sensor for regulating the temperature of the fuel cell by adjusting the valve and for controlling a circulation direction of the thermal fluid in the loop.

2. The system of claim 1 where the fuel cell further provides electrical power to the plant.

3. The system of claim 1 where the fuel cell further provides electrical power to the digital control unit.

4. The system of claim 1 further comprising a DC/AC power converter coupled to the output of the fuel cell.

5. The system of claim 4 where the power converter supplies electrical power to the geothermal unit.

6. The system of claim 4 where the power converter supplies electrical power to the plant.

7. The system of claim 1 where the fuel cell comprises a fuel converter unit and a fuel reformer unit.

8. The system of claim 7 where the heat exchanger comprises a first heat-exchange unit coupled to the converter unit and a second heat-exchange unit coupled to the reformer unit.

9. The system of claim 7 where the valve comprises:

a first valve unit for bypassing a variable portion of the thermal fluid around the first heat-exchange unit; and a separate second valve unit for bypassing a variable portion of the thermal fluid around the second heat-exchange unit.

10. The system of claim 7 where the sensor senses temperatures of the converter unit and of the reformer unit separately and the digital control unit regulates the temperatures of the converter unit and of the reformer unit separately.

11. The system of claim 1 where the thermal fluid circulates from the geothermal unit to the geothermal field to the heat exchanger thence back to the geothermal unit so as to heat the plant.

12. The system of claim 1 where the thermal fluid circulates from the geothermal unit to the heat exchanger to the geothermal field thence back to the geothermal unit so as to cool the plant.

13. A method comprising:

circulating a thermal fluid in a loop among a heat exchanger, a geothermal unit, and a geothermal field;

digitally controlling a temperature of a fuel cell in thermal contact with the heat exchanger by bypassing an adjustable portion of the thermal fluid around the heat exchanger, and wherein the thermal fluid is circulated in the loop in a first direction for cooling and circulated in the loop in a second direction for heating; and supplying electrical power from the fuel cell to the geothermal unit.

14. The method of claim 13 further comprising:

defining a range of temperatures around an upper bound for safe and efficient operation of the fuel cell; and sensing an actual temperature of the fuel cell.

15. The method of claim 14 further comprising:

bypassing less of the thermal fluid as the actual temperature increases within the range of temperatures; and bypassing more of the thermal fluid as the actual temperature decreases within the range of temperatures.

16. The method of claim 13 where the bypassing operation includes:

sensing a temperature of a converter unit of the fuel cell;

bypassing an adjustable portion of the thermal fluid around a first heat-exchange unit in thermal contact with the converter unit in response to the sensed temperature of the converter unit;

sensing a temperature of a reformer unit of the fuel cell;

bypassing an adjustable portion of the thermal fluid around a second heat-exchange unit in thermal contact with the converter unit in response to the sensed temperature of the converter unit, independently of the bypassing operation round the first heat-exchange unit.

17. The method of claim 13 further comprising controlling a temperature of a plant coupled to the geothermal unit, independently of controlling the temperature of the fuel cell.

18. The method of claim 13 where the controlling operation employs fuzzy logic.

19. A medium bearing instructions and data readable by a suitably programmed digital controller for executing the method of claim 13.

20. A hybrid energy system comprising:

a geothermal unit for heating and/or cooling a plant;

a fuel cell having an output for supplying electrical power to the geothermal unit;

a heat exchanger coupled to the fuel cell;

a loop for circulating a thermal fluid among the heat exchanger, the geothermal unit, and a geothermal field;

a valve for bypassing a variable portion of the thermal fluid around the heat exchanger;

a sensor for sensing a temperature of the fuel cell;

a digital control unit coupled to the sensor for regulating the temperature of the fuel cell by adjusting the valve; and wherein the fuel cell comprises a fuel converter unit and a fuel reformer unit; and wherein the valve comprises a first valve unit for bypassing a variable portion of the thermal fluid around the first heat-exchange unit and a separate second valve unit for bypassing a variable portion of the thermal fluid around the second heat-exchange unit.

21. A hybrid energy system comprising:

a geothermal unit for heating and/or cooling a plant;

a fuel cell having an output for supplying electrical power to the geothermal unit;

a heat exchanger coupled to the fuel cell;

a loop for circulating a thermal fluid among the heat exchanger, the geothermal unit, and a geothermal field;

a valve for bypassing a variable portion of the thermal fluid around the heat exchanger;

a sensor for sensing a temperature of the fuel cell;

a digital control unit coupled to the sensor for regulating the temperature of the fuel cell by adjusting the valve; and wherein the fuel cell comprises a fuel converter unit and a fuel reformer unit; and wherein the sensor senses temperatures of the converter unit and of the reformer unit separately and the digital control unit regulates the temperatures of the converter unit and of the reformer unit separately.

22. A method comprising:

circulating a thermal fluid in a loop among a heat exchanger, a geothermal unit, and a geothermal field;

digitally controlling a temperature of a fuel cell in thermal contact with the heat exchanger by bypassing an adjustable portion of the thermal fluid around the heat exchanger; and supplying electrical power from the fuel cell to the geothermal unit; and wherein the bypassing operation includes:

sensing a temperature of a converter unit of the fuel cell;

bypassing an adjustable portion of the thermal fluid around a first heat-exchange unit in thermal contact with the converter unit in response to the sensed temperature of the converter unit;

sensing a temperature of a reformer unit of the fuel cell; and bypassing an adjustable portion of the thermal fluid around a second heat-exchange unit in thermal contact with the converter unit in response to the sensed temperature of the converter unit, independently of the bypassing operation around the first heat-exchange unit.

* * * * *

UNITED STATES PATENT AND TRADEMARK OFFICE

CERTIFICATE OF CORRECTION

PATENT NO. : 7,334,406 B2
APPLICATION NO. : 11/047415
DATED : February 26, 2008
INVENTOR(S) : Licari et al.

It is certified that error appears in the above-identified patent and that said Letters Patent is hereby corrected as shown below:

In column 8, line 5, in Claim 16, delete “round” and insert -- around --, therefor.

Signed and Sealed this

Seventeenth Day of June, 2008

JON W. DUDAS
*Director of the United States Patent and Trademark Office*